US005727698A

United States Patent [19]

Lai

[11] Patent Number: 5,727,698

[45] Date of Patent: Mar. 17, 1998

[54] HOOK DEVICE

[76] Inventor: Yung-Tsai Lai, No. 42, Lane 408, Tung-Kuang Rd., Taichung City, Taiwan

[21] Appl. No.: 715,525

[22] Filed: Sep. 18, 1996

[51] Int. Cl.[6] ..... A47F 5/08

[52] U.S. Cl. ..... 211/87.01; 248/215; 248/301; 211/94.01

[58] Field of Search ..... 211/87.01, 94.01, 211/162, 183; 248/339, 304, 205.1, 215, 301

[56] References Cited

U.S. PATENT DOCUMENTS

| | | | |
|---|---|---|---|
| 46,296 | 2/1865 | Colburn | 211/94 |
| 177,936 | 5/1876 | Haines | 211/87 |
| 354,903 | 12/1886 | Hastings | 211/87 X |
| 1,642,428 | 9/1927 | Schutten | 248/215 |
| 1,995,246 | 3/1935 | Greims | 211/94 |
| 2,987,289 | 6/1961 | Wamsley | 248/304 X |
| 3,191,777 | 6/1965 | Willits, Jr. | 211/87 |
| 4,194,637 | 3/1980 | Edson | 211/59.1 X |
| 4,264,013 | 4/1981 | Vollmer | 248/304 X |
| 4,372,450 | 2/1983 | Licari et al. | 248/304 X |
| 4,658,967 | 4/1987 | Wang | 211/94 |
| 4,771,897 | 9/1988 | Ho | 211/94 |

*Primary Examiner*—Ramon O. Ramirez
*Assistant Examiner*—Kimberly Wood
*Attorney, Agent, or Firm*—Banner & Witcoff, Ltd.

[57] ABSTRACT

A hook device includes an elongated horizontal positioning plate having upper and lower longitudinal edges and a rear face formed with a plurality of insert grooves which extend between the upper and lower longitudinal edges, a plurality of hook members, each of which has a straight portion with upper and lower ends, each of the upper and lower ends being formed with a forwardly extending hook projection, the straight portion of each of the hook members being received in one of the insert grooves of the positioning plate, and an elongated horizontal retaining plate mounted on the rear face of the positioning plate in such a manner that the straight portion of each of the hook members is sandwiched between the positioning plate and the retaining plate.

3 Claims, 5 Drawing Sheets

HOOK DEVICE

BACKGROUND OF THE INVENTION

1. Field of the Invention

The present invention relates to a hook device, more particularly to a hook device for use in a jewelry cabinet.

2. Description of the Related Art

FIG. 1 illustrates a conventional jewelry cabinet 10. The jewelry cabinet 10 includes a door 13 having an inner side mounted with a plurality of hook members 14 for hanging jewelry, such as rings, earrings, necklaces, etc., thereon.

Each of the hook members 14 has a base plate 141 formed with a through hole 142 for a screw 143 to pass therethrough so as to mount the hook member 14 on the inner side of the door 13. Since each of the hook members 14 has to be mounted individually on the door 13, mounting of the hook members 14 is a time-consuming and labor-consuming task, especially when a relatively large number of hook members 14 is involved.

SUMMARY OF THE INVENTION

The main object of this invention is to provide a hook device which can be easily assembled and mounted on an inner side of a wall of a jewelry cabinet.

Accordingly, the hook device of this invention includes:

an elongated horizontal positioning plate having upper and lower longitudinal edges and a rear face formed with a plurality of insert grooves which extend between the upper and lower longitudinal edges;

a plurality of hook members, each of which has a straight portion with upper and lower ends, each of the upper and lower ends being formed with a forwardly extending hook projection, the straight portion of each of the hook members being received in one of the insert grooves of the positioning plate; and an elongated horizontal retaining plate mounted on the rear face of the positioning plate in such a manner that the straight portion of each of the hook members is sandwiched between the positioning plate and the retaining plate.

BRIEF DESCRIPTION OF THE DRAWINGS

Other features and advantages of this invention will become apparent in the following detailed description of the preferred embodiment with reference to the accompanying drawings, of which.

DETAILED DESCRIPTION OF THE PREFERRED EMBODIMENT

Figure 1:
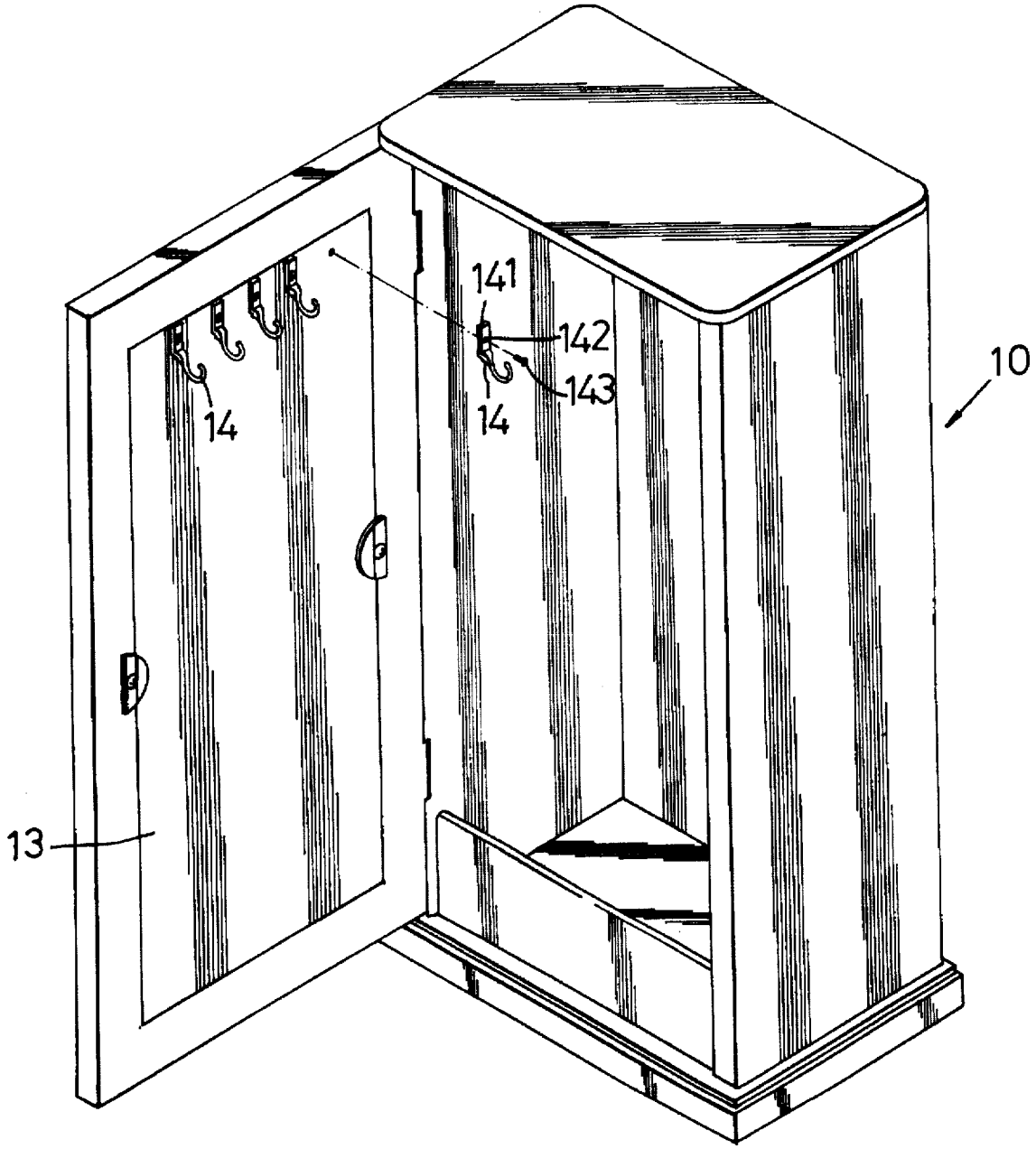
FIG. 1 PRIOR ART
FIG. 1 is a perspective view illustrating a jewelry cabinet that is provided with a plurality of conventional hook members.
Figure 2:
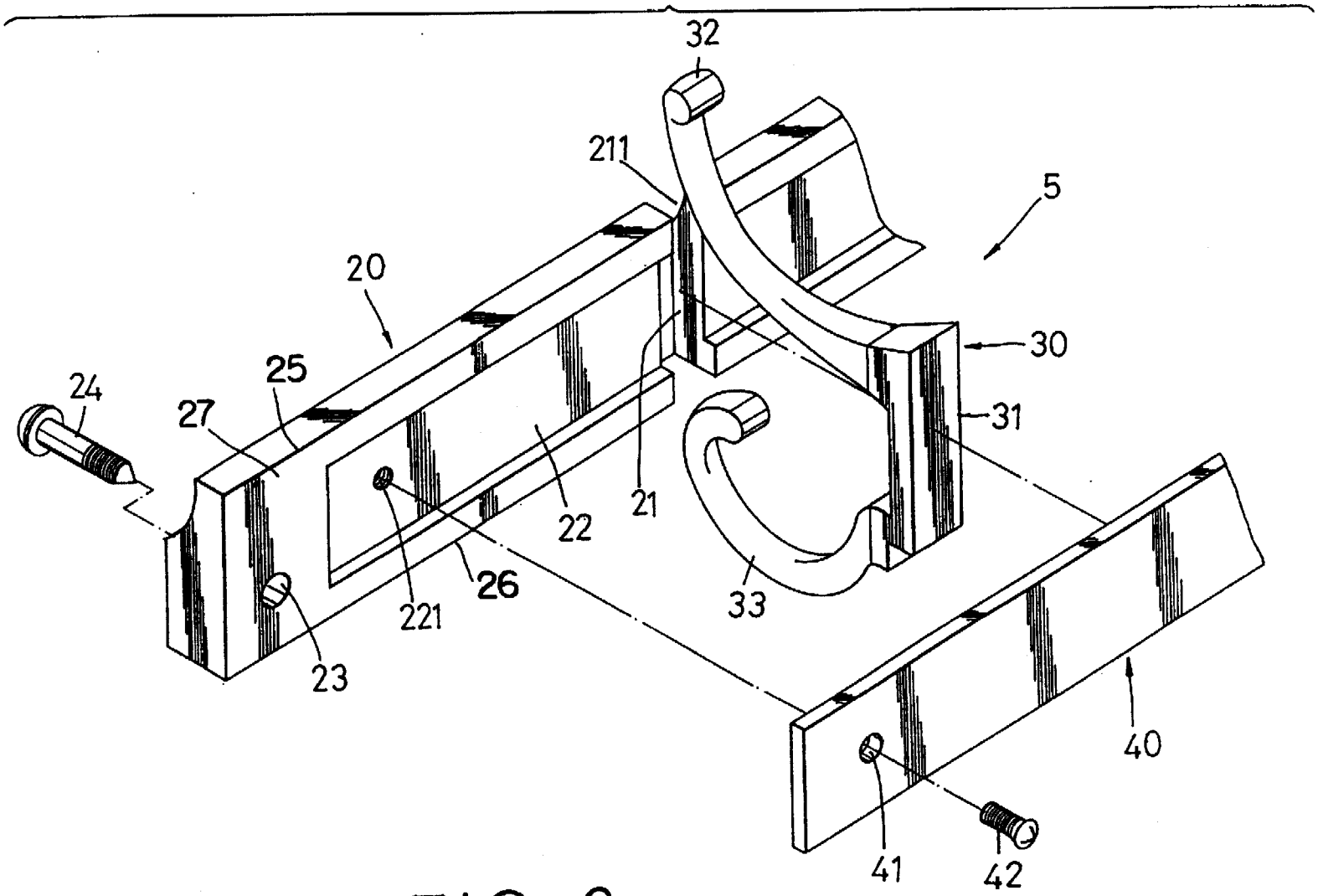
FIG. 2 is an exploded perspective view of the preferred embodiment of a hook device of this invention.
Figure 3:
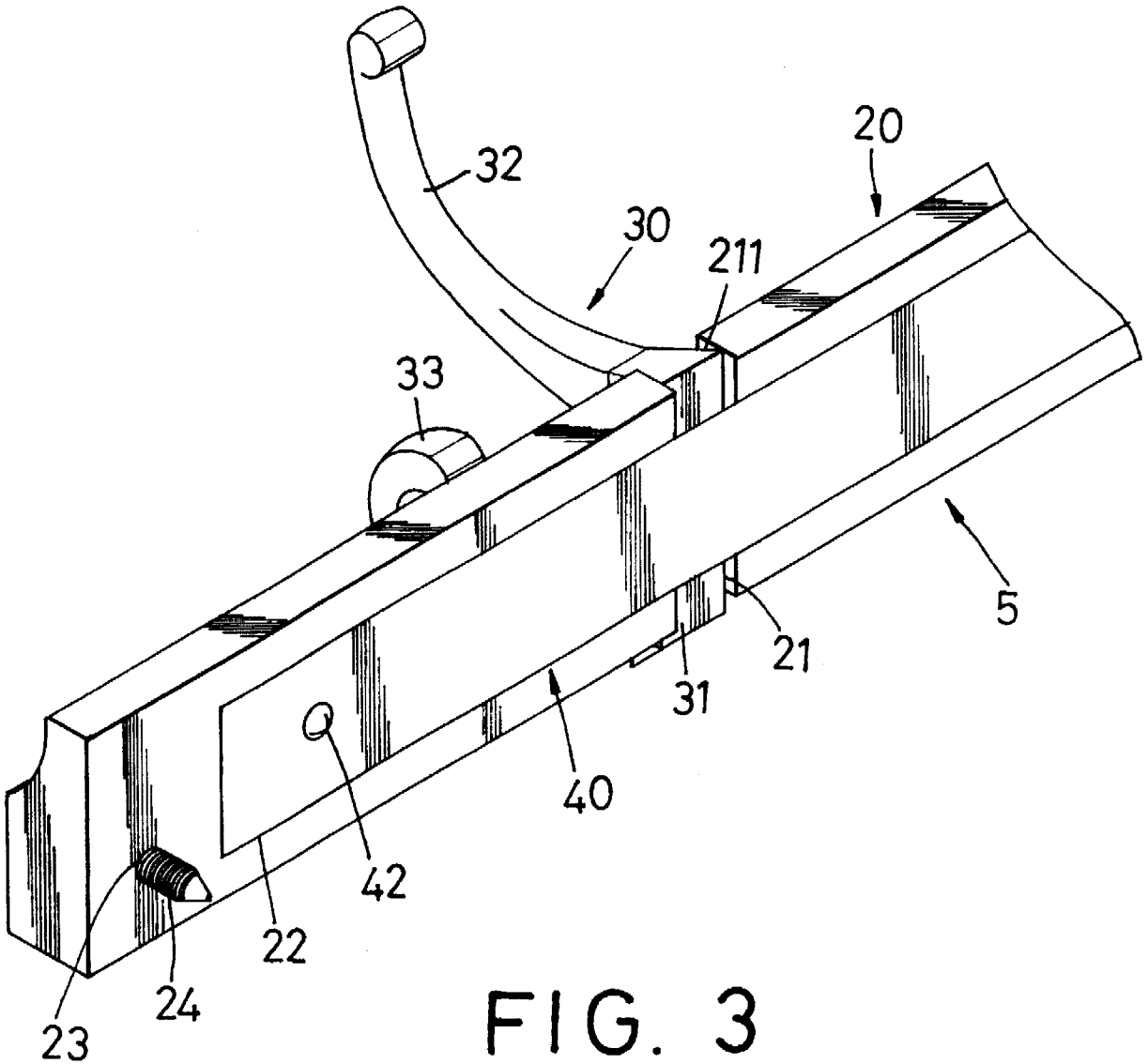
FIG. 3 is a rear perspective view of the preferred embodiment.

Referring to FIGS. 2 and 3, the preferred embodiment of a hook device 5 according to this invention is shown to include an elongated horizontal positioning plate 20, a plurality of hook members 30 and an elongated horizontal retaining plate 40.

The positioning plate 20 has a size and thickness suitable for mounting on an inner side of a wall or a door of a jewelry cabinet. The positioning plate 20 has upper and lower longitudinal edges 25 and 26, respectively, a front face which may be formed with decorative designs, and a rear face 27 formed with a plurality of insert grooves 21 which extend between the upper and lower longitudinal edges 25 and 26. Each of the insert grooves 21 has a notch 211 formed on the upper longitudinal edge of the positioning plate 20. The rear face 27 of the positioning plate 20 is further formed with a recess 22 which has a size substantially corresponding to that of the retaining plate 40. The positioning plate 20 has at least one internally threaded through hole 221 formed in the recess 22 thereof and at least one mounting hole 23 formed through an end portion thereof.

Each of the hook members 30 has a straight portion 31 with upper and lower ends. The upper end of the straight portion 31 is formed with an upper hook projection 32. The lower end of the straight portion 31 is formed with a lower hook projection 33. Both the upper and lower hook projections 32 and 33 extend forwardly and generally upwardly from the straight portion 31. The straight portion 31 of each of the hook members 30 is received in one of the insert grooves 21 of the positioning plate 20 in such a manner that the positioning plate 20 is positioned between the upper and lower hook projections 32 and 33 of the hook members 30. The upper hook projection 32 of each of the hook members 30 passes through the notch 211 of a respective one of the insert grooves 21.

The retaining plate 40 is fittingly retained in the recess 22 of the positioning plate 20 in such a manner that the straight portion 31 of each of the hook members 30 is sandwiched between the positioning plate 20 and the retaining plate 40. The retaining plate 40 has at least one through hole 41 that is formed in an end portion thereof and that is registered with the internally threaded through hole 221 of the positioning plate 20. The retaining plate 40 is mounted on the positioning plate 20 by means of a screw fastener 42 that passes through the through hole 41 and the internally threaded through hole 221 and that engages the positioning plate 20.

Figure 4:
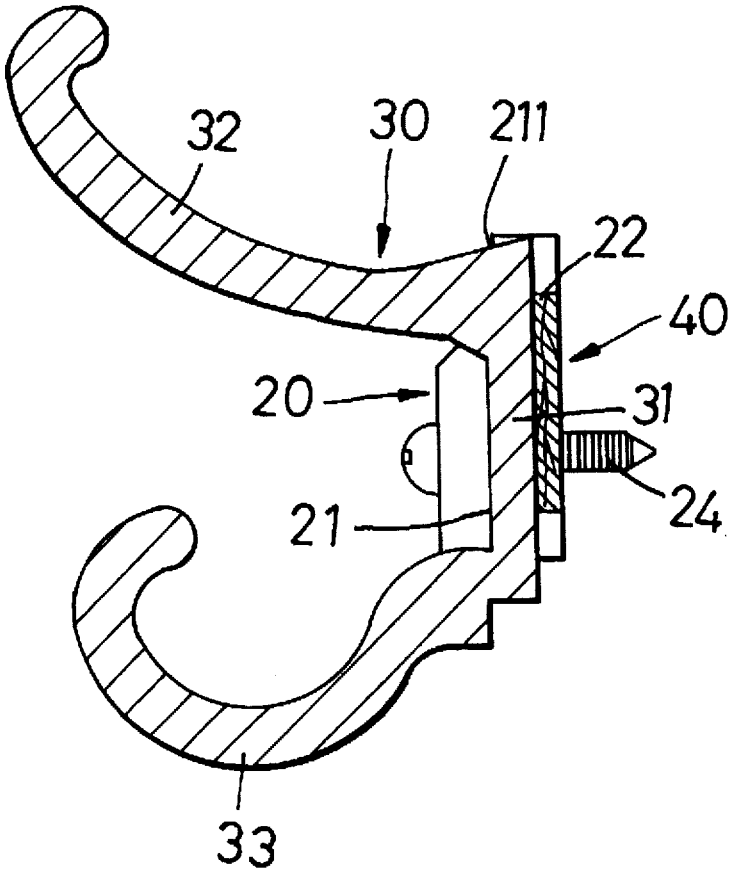
FIG. 4 is a cross-sectional view of the hook device shown FIG. 3.

Referring to FIGS. 2 and 4, to assemble the hook device 5 of this invention, each of the hook members 30 are positioned on the positioning plate 20 so that the straight portion 31 thereof is received in one of the insert grooves 21, the upper hook projection 32 passes through one of the notches 211 and the lower hook projection 33 extends through the lower longitudinal edge of the positioning plate 20. In this situation, the positioning plate 20 is positioned between the upper and lower hook projections 32 and 33. The retaining plate 40 is subsequently disposed on the rear face 27 of the positioning plate 20 so as to be retained in the recess 22 of the positioning plate 20 and such that the through hole 41 of the retaining plate 40 is aligned with the internally threaded through hole 221 of the positioning plate 20. The hook members 30 are thereby limited in the insert groove 21 and sandwiched between the positioning plate 20 and the retaining plate 40. The fasteners 42 are passed through the through holes 41 and 221 to mount the retaining plate 40 on the rear face 27 of the positioning plate 20.

Figure 5:
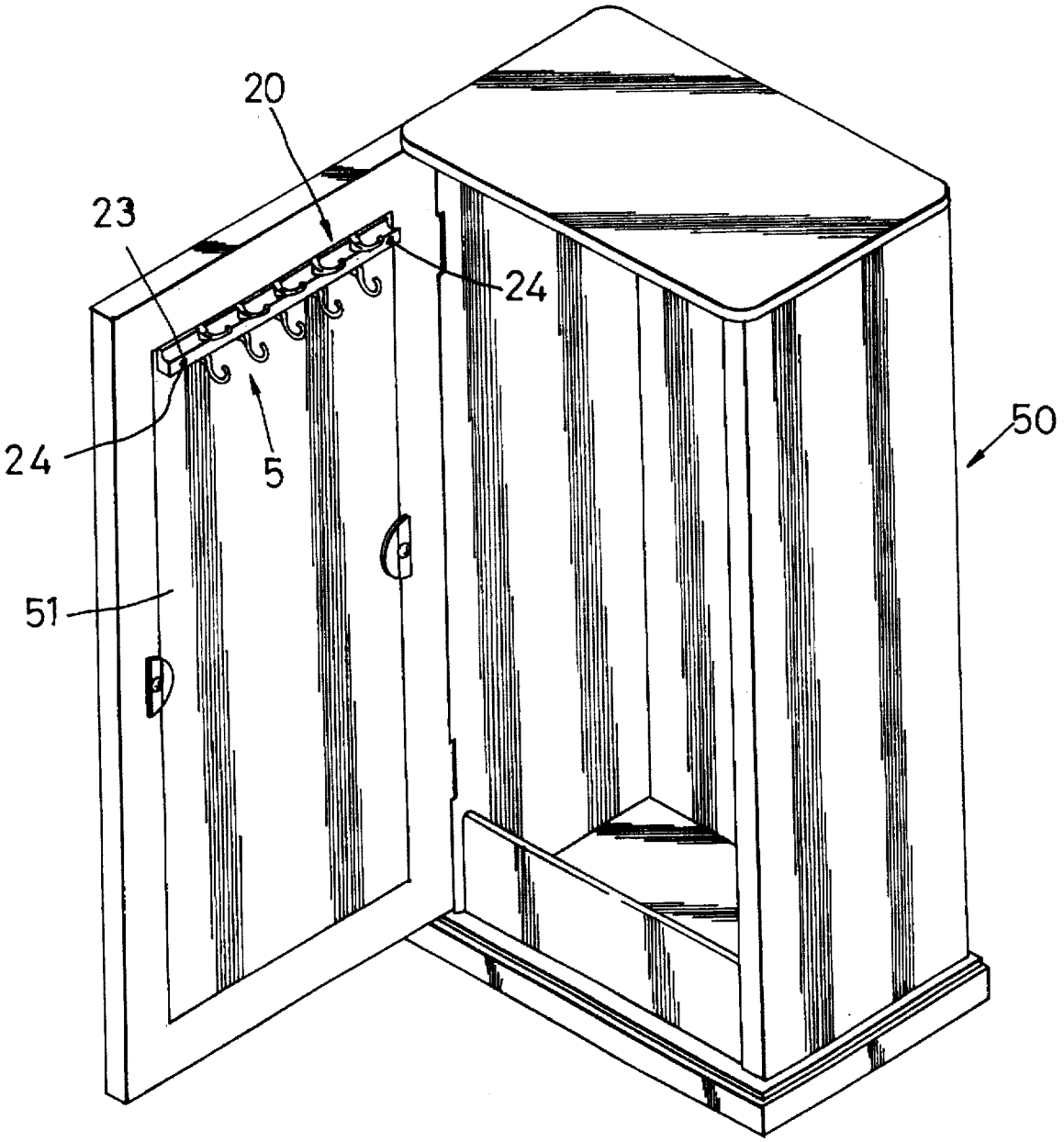
FIG. 5 is a schematic view illustrating a jewelry cabinet that is provided with the preferred embodiment.

Referring to FIG. 5, to mount the hook device 5 of this invention on an inner side of a door 51 of a jewelry cabinet 50, the hook device 5 is disposed at a predetermined suitable position of the inner side of the door 51, and a pair of bolts 24 are extended through the mounting holes 23 respectively to engage the door 51. Thus, the entire hook device 5 is fixed on the inner side of the door 51 of the jewelry cabinet 50 for hanging necklaces, earrings, etc., thereon.

Therefore, the hook device of this invention can be quickly assembled and easily mounted on an inner side of a wall of a jewelry cabinet by the consumer and is thus more convenient and more economical than the conventional hook members described beforehand.

With this invention thus explained, it is apparent that numerous modifications and variations can be made without departing from the scope and spirit of this invention. It is therefore intended that this invention be limited only as indicated in the appended claims.

I claim:

1. A hook device comprising:

an elongated horizontal positioning plate having upper and lower longitudinal edges and a rear face formed with a plurality of insert grooves which extend between said upper and lower longitudinal edges;

a plurality of hook members, each of which has a straight portion with upper and lower ends, each of said upper and lower ends being formed with a forwardly extending hook projection, said straight portion of each of said hook members being received in one of said insert grooves of said positioning plate; and an elongated horizontal retaining plate mounted on said rear face of said positioning plate, said rear face of said positioning plate being formed with a recess having a size substantially corresponding to that of said retaining plate, for fittingly retaining said retaining plate therein in such a manner that said straight portion of each of said hook members is sandwiched between said positioning plate and said retaining plate.

2. The hook device according to claim 1, further comprising screw fasteners that pass through said retaining plate and that engage said positioning plate for mounting said retaining plate on said positioning plate.

3. The hook device according to claim 1, wherein said positioning plate has at least one mounting hole formed therethrough.

* * * * *